United States Patent [19]

LaPorte

[11] 4,175,841

[45] Nov. 27, 1979

[54] PHOTO-TYPEWRITER

[76] Inventor: Gordon J. LaPorte, 60 W. 25th St., New York, N.Y. 10010

[21] Appl. No.: 873,851

[22] Filed: Jan. 31, 1978

[51] Int. Cl.[2] ..... B41B 13/10

[52] U.S. Cl. ..... 354/5; 400/613.2; 400/636; 400/718; 346/108

[58] Field of Search ..... 354/5, 6; 400/613.2, 400/681, 718, 636; 178/15, 30; 346/108

[56] References Cited

U.S. PATENT DOCUMENTS

| | | | |
|---|---|---|---|
| 1,535,322 | 4/1925 | Latta | 400/681 |
| 1,830,478 | 11/1931 | Moseley | 400/718 |
| 2,392,224 | 1/1946 | Bryce | 354/6 X |
| 3,832,488 | 8/1974 | Fahey et al. | 178/15 |
| 3,939,956 | 2/1976 | Stamou | 400/613.2 X |
| 3,965,476 | 6/1976 | Wenander | 354/5 |

FOREIGN PATENT DOCUMENTS

| | | | |
|---|---|---|---|
| 1293058 | 2/1962 | France | 400/718 |

*Primary Examiner*—L. T. Hix
*Assistant Examiner*—William B. Perkey
*Attorney, Agent, or Firm*—Leonard W. Suroff

[57] ABSTRACT

An electronic typewriter comprising portable housing means having a typewriter keyboard comprising a plurality of individual finger keys on the housing means and being readily engageable by the user thereof, with chamber means in the housing means for containing a replaceable supply of paper. The paper having an emulsion sensitive to one portion of the light spectrum as an activating agent for producing tonal changes in the emulsion, and sensitive to another portion of the light spectrum as a retarder to stop further tonal change in the emulsion. Grid means is operatively associated with the housing means and extends in a substantially straight line to produce printed lines, with the grid means comprising printing filaments to which the paper is exposed, and the filaments being capable of producing light in the portion of the spectrum for producing the tonal changes in the emulsion. Coupling means electrically interconnects the keys to the grid means so as to progressively activate the grid means across the line in response to each of the keys on the keyboard being engaged during typing, and advancing means for moving the paper from the chamber means relative to the grid means, so as to produce line by line exposure of the paper to the grid means, such that the printed grid line is thereafter exposed to the light of the other portion of the light spectrum so as to stop the tonal change in the emulsion, such that printed typewritten lines are produced on the paper.

16 Claims, 9 Drawing Figures

PHOTO-TYPEWRITER

BACKGROUND OF THE INVENTION

The invention relates to typewriters, and more particularly to an electronic typewriter capable of operation with particular types of paper materials to electronically by a photo-sensitive process record and produce characters thereon in typewritten form.

The typewriter art has remained substantially the same for a prolonged period of time, with the major change being from a manual to an electric typewriter, and the various forms of electric typewriters that are presently on the market. In each instance the electric typewriter requires utilization of a hardened steel key impressed against a ribbon in order to obtain the desired alpha-numeric symbol on the paper that is inserted within the typewriter. The resultant contact producing or emitting an audible click. This is substantially the present state of the art as it relates to the field of typewriters.

In contrast to the above, I have developed a typewriter that utilizes photo-sensitive paper that when exposed at a particular region of the light spectrum produces an image that is both visible and stable on the paper. Photo-sensitive papers are known and have been used for other applications and reference may be made to U.S. Pat. Nos. 3,033,678 and 3,794,491. I have now discovered that it is possible to combine papers having certain emulsions that are sensitive to a particular portion of the light spectrum in an electronic typewriter. The electronic typewriter eliminates the need of a ribbon and the metallic element that normally engages the ribbon as well as the audible sounds which accompany its operation. In this manner a novel electronic typewriter, as hereinafter disclosed in detail, is provided for the user so as to further advace the state of the art of typewriters, and make an important contribution thereto.

OBJECTS OF THE INVENTION

An object of the present invention is to provide an electronic portable typewriter that utilizes photo-sensitive paper and is automatically developed when activated by certain types of light.

Another object of the present invention is to provide an electronic typewriter having a keyboard, which when touched in a normal manner of typing, will produce on the paper within the typewriter printed lines of information thereon.

Another object of the present invention is to provide an electronic typewriter that utilizes a row of incandescent filament grids that are energized in sequence so as to obtain the character image desired on the paper within the typewriter.

Another object of the present invention is to provide an electronic typewriter that does not produce any audible sound.

Another object of the present invention is to provide a machine capable of printing out entire sentences or paragraphs from a memory storage means linked to a readout means.

Other objects and advantages of the present invention will become apparent as the disclosure proceeds.

SUMMARY OF THE INVENTION

An electronic typewriter comprising portable housing means including a readout window extending across the housing means, and chamber means for receiving a supply of paper therein, with a typewriter keyboard comprising a plurality of individual finger keys on the housing means and being readily engagable by the user thereof.

A supply of paper having an emulsion sensitive to one portion of the light spectrum as an activating agent for producing tonal changes in the emulsion, and sensitive to another portion of the light spectrum as a retarder to stop further tonal change in the emulsion is contained within the chamber.

Grid means is operatively associated with the housing means and extending in a substantially straight line to produce printed lines, with the grid means comprising printing filaments to which the paper is exposed, and the filaments being capable of producing light in the portion of the spectrum for producing the tonal changes in the emulsion. The light glowing images of the grid means corresponding to the letter, numeral, or punctuation being touched on the keyboard, and the character image is then transferred photo-sensitively to the emulsion on the paper surface.

Coupling means electrically interconnects the keys to the grid means so as to progressively activate the grid means across the line in response to each of the keys on the keyboard being engaged during typing. Means for activating the grid means in another portion of the light spectrum is provided to erase or reverse the chemical reaction initiated by the first portion of the light spectrum to which the paper was first exposed.

Advancing means is provided for moving the paper from the chamber means relative to the grid means, and the readout window so as to produce line by line exposure of the paper to the grid means, such that the printed grid line is thereafter exposed to the light of the other portion of the light spectrum so as to stop the tonal change in the emulsion. In this manner printed typewritten lines are produced on the paper. The advancing means including rollers engaging opposite sides of the paper for advancing same, and paper support means extending rearwardly of the housing means to support the paper as it exits from the housing means.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION OF THE DRAWINGS

Figure 1:
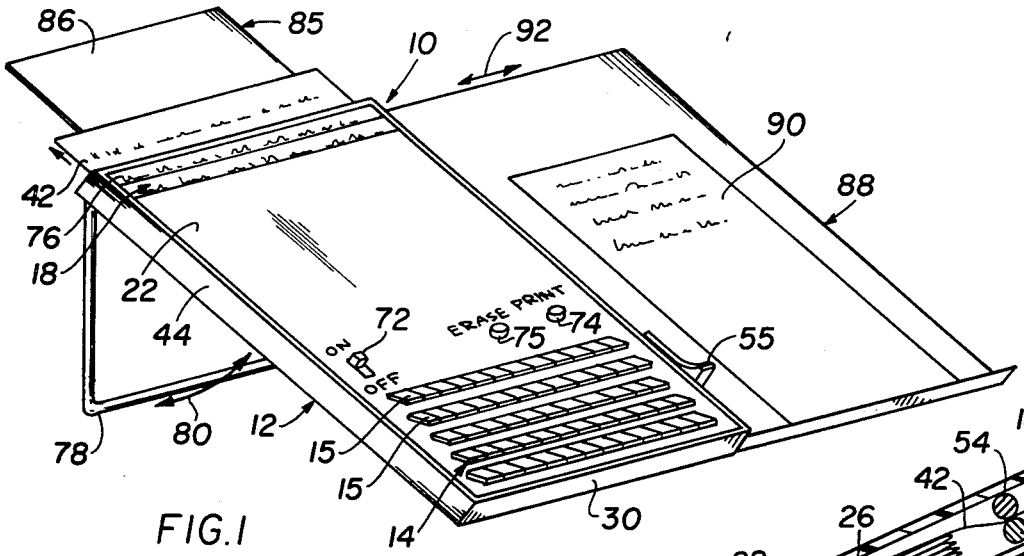
FIG. 1 is a perspective view of the electronic typewriter in accordance with the present invention.

Referring now to the drawings, and initially to FIGS. 1 through 8 thereof, there is illustrated a typewriter 10 in accordance with the present invention that utilizes electronic means to obtain the printed information on the supply of paper 11 associated with the typewriter 10. To accomplish the end purpose of permitting a continuous feeding of the paper from within the typewriter 10, there is provided an interrelated combination of a portable housing means 12 having associated therewith a typewriter keyboard 14, comprising a plurality of individual finger keys 15 that are readily engagable by the user thereof.

Figure 2:
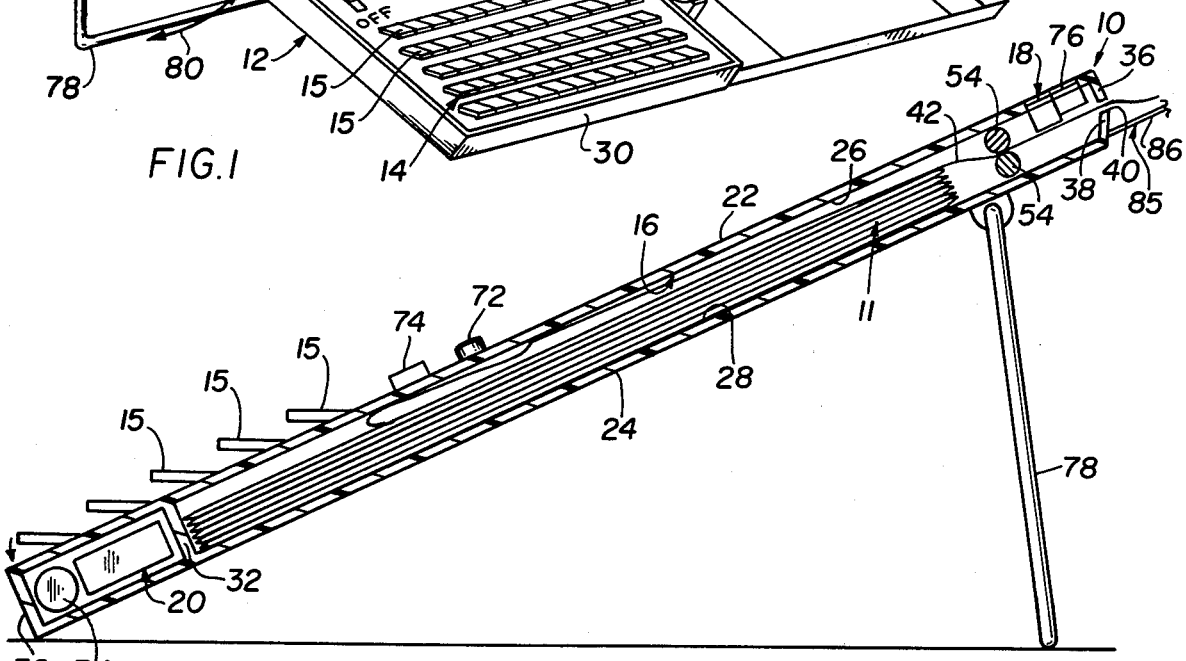
FIG. 2 is a side view, in section, illustrating the positionment of the paper within the typewriter and other operating characteristics thereof.
Figure 7:
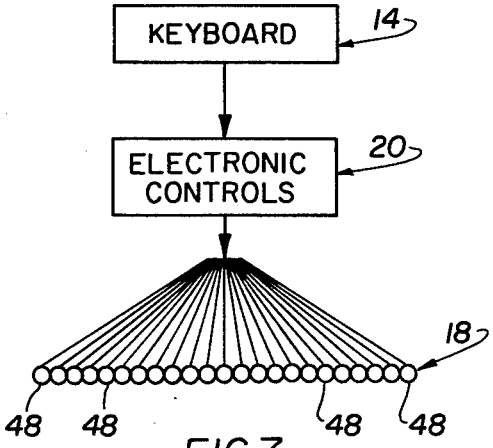
FIG. 7 is a schematic diagram of the electronic control system of the invention for each of the individual filaments utilized for activating the emulsion on the paper.

The novel combination further includes chamber means 16 as illustrated in FIG. 2, that is capable of retaining an ample supply of paper 11 therein to permit the necessary typing. In conjunction with the chamber means 16, and typewriter keyboard 14, there is provided grid means 18 operatively associated with the housing means 12 and extending in a substantially straight line to produce printed lines of information in response to the activation of the individual keys 15. In operative relationship with the individual keys 15 there is provided coupling means 20, as illustrated in FIG. 7, that extends between the grid means 18 and the keyboard 14. The coupling means 20 serves the function to progressively activate the grid means 18 in response to each of the keys 15 being activated on the keyboard 14 during typing.

The housing means 12 comprises an upper or front panel 22 having a rear panel 24 in spaced relationship thereto, as illustrated in FIG. 2. The upper panel 22 has an inner wall 26, and the bottom lower panel 24 has an inner wall 28. The spacing between the respective walls 26 and 28 may define the spacing available for the width or height of the chamber means 16, as illustrated in FIG. 2. The housing means 12 further defines a lower or bottom wall 30 and an intermediate or chamber wall 32 in spaced relationship therewith. The spacing defined between the walls 30 and 32, as well as the upper or front panel 22 and bottom panel 24, provides the necessary positionment for the coupling means 20 to be contained. The coupling means 20 may be powered by an electric cord in a conventional manner, or if desired the coupling means 20 may be powered by one or more batteries 34 electrically connected to the coupling means 20.

Figure 4:
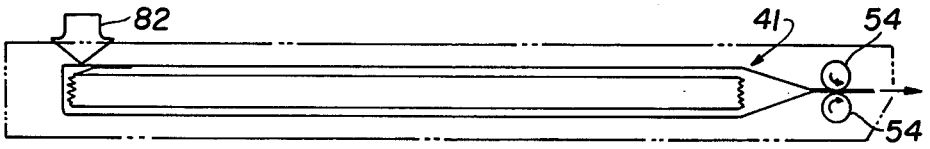
FIGS. 4, 5 and 6 are somewhat schematic views illustrating the manner in which a package of photo-sensitive paper would be initially positioned within the typewriter and subsequently advanced layer by layer.
Figure 5:
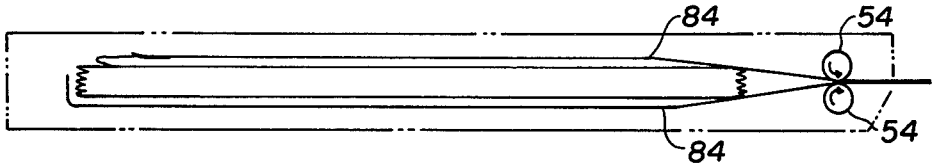
Figure 6:
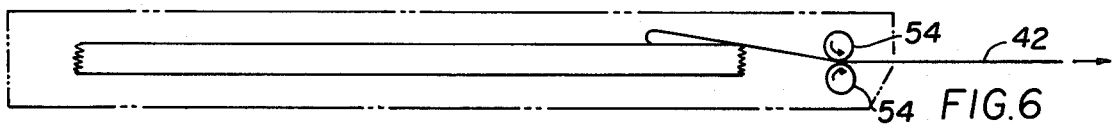

The chamber means 16 further includes a pair of rear walls 36 and 38 having a transversely extending opening 40 extending therebetween for permitting the exiting of the paper 42 contained within the chamber means 16. The paper supply 11 may be packaged in various assorted arrangements. One such packaging arrangement is illustrated in FIGS. 4 through 6 and will be hereinafter discussed. The supply of paper 11 includes sheets or layers of paper 42 as illustrated in FIG. 2, in the form of overlapping sheets that are adapted to be continuously fed past the grid means 18 and exposed for a definitive period of time to activate the emulsion.

Figure 8:
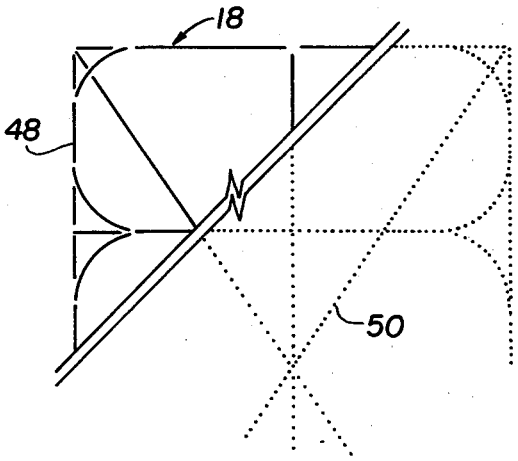
FIG. 8 is a schematic diagram illustrating two forms of filament grid networks that may be utilized for obtainment of the activation of the emulsion on the paper.

The housing means 12 further includes a pair of side walls 44 and 46 that may further define the chamber means 16 in which the paper supply 11 is maintained. The chamber means 16 is designed such that it is sealed to prevent light from entering therein. In this manner the portion of the paper sheet 42 for receiving impressions is exposed only to light produced by the filaments 48, as illustrated in FIG. 8. The filaments 48 form the portion of the grid means 18 designed to provide the necessary light in a given pattern to expose the paper 42. The filaments 48 may take several forms, and as illustrated in FIG. 8, two such forms of the filaments are being illustrated. The filament construction for the micro-printed filament form is illustrated in the upper left hand corner of FIG. 8 and is designated by numeral 48, and will be referred to in the specification.

A point dot illumination construction, indicated by reference numeral 50 and illustrated in the lower right hand corner of FIG. 8, illustrates an alternate construction for the filaments utilized in the grid means 18. Other variations may be employed to obtain the desired end results.

Accordingly, the typewriter 10 of the present invention may have the housing means 12 that is no thicker than a pad of paper and completely noiseless. The printing mechanism utilizes the row of incandescent filament grid 48, which may be similar to those used for readout numerals in miniaturized digital calculators, and can be energized to produce a glow of light in the spectrum necessary to activate the emulsion on the paper 42. In this arrangement the typewriter 10 has no moving parts, except for rollers or other means utilized to advance the paper 42 and the finger keys 15.

The character image of the filaments 48 form either alphabet or numeral characters, that are produced instantaneously at each point in the sentence being typed by the individual filament grids 48 which are positioned above that particular point on the grid line. There is a separate grid unit 48 for each possible character space in the line being typed. As a typed line is completed the paper 42 is advanced, bringing a blank section of the paper 42 ready to be printed thereon for the continuous typing, as is the case in a conventional typewriter. The grid means 18, as illustrated in FIG. 2, is positioned and mounted from the front panel 22, such that it extends adjacent the paper 42 that is being fed on an intermittent basis thereacross.

To obtain the advancement of the paper 42 on an intermittent basis, there is provided advancing means 52 that may take various forms and shapes. In accordance with the preferred embodiment of the present invention, the advancing means 52 may comprise a pair of rollers 54 mounted within the housing means 12 and adjacent to the chamber means 16. Although the rollers 54 are illustrated as mounted prior to the grid means 18, it is appreciated that they may be mounted subsequent thereto. The rollers 54 when rotated advance the paper 42 in a conventional manner.

The indexing means or advancing means 52 may be designed such that the rollers 54 are rotated by means of an arm 55 mounted relative to the housing means 12 and reciprocatable relative thereto. The arm 55 is mounted by means of brackets 56 on the side wall 46, the forward end 58 of the arm 55 includes a ratchet type set of teeth 60 that mate with a gear 62 extending outwardly from the housing means 12 and having a peripheral set of teeth 64 that meets with the ratchet teeth 60. The gear 62 is mounted relative to one of the rollers 54, such that rotation of gear 62 effects angular rotation of one of the rollers 54. The tension between the rollers being such that they both move simultaneously, or that gear 62 is coupled to both rollers for positive movement thereof in a conventional linkage mechanism including a means for reversing the ratchet motion.

In order to determine the amount of spacing between the lines as is the case in a normal typewriter, there is provided stop means 65 that includes a stop member 66 adapted to be received within respective notches 68 on the side wall 46 of the housing means 12. The notches 68 as designated are for one, two, or three spaces, such that depending upon what is being typed, the spacing may be adjusted.

Accordingly, the user of the typewriter after the completion of a single line of information onto the paper 42, applies a manual force in the direction of single headed arrow 70 which moves forward gear 62 and in turn rollers 54. The linkage may be so designed such that it may be then returned to the rest position with or without rerolling of the rollers 54. In this manner the advancing means 52 is such that a line by line exposure of the paper 42 can take place. The grid means 18, as illustrated in FIG. 1, extends transversely across the paper 42 which continues to emerge from the upper end of the housing means 12.

In operation the user of the typewriter 10 initially turns on the power switch 72 which may be positioned on the front panel 22, as illustrated in FIG. 1. When in this position the power from the battery 34, or other source of electrical energy, is coupled to the control means 20, which is electrically connected to the grid means 18 having the individual filaments 48 connected thereto by conventional wiring system. In this manner, depending upon the key 15 activated, the electronic controls will in turn reproduce the image of the numeral or alphabetical symbol on a particular grid 48 in sequence across a line of the paper 42.

Additional controls are provided to permit the typewriter 10 to either type or erasure to take place. To accomplish this task a print switch 74 is provided and an eraser switch 75 is provided that are both mounted on the front panel 22. In cooperation with the erasure switch 75 there is a viewing panel or readout window 76 that extends across the front panel 22 in plane substantially parallel to the grid means 18. The importance of the readout window will become evident as the disclosure proceeds.

Figure 3:
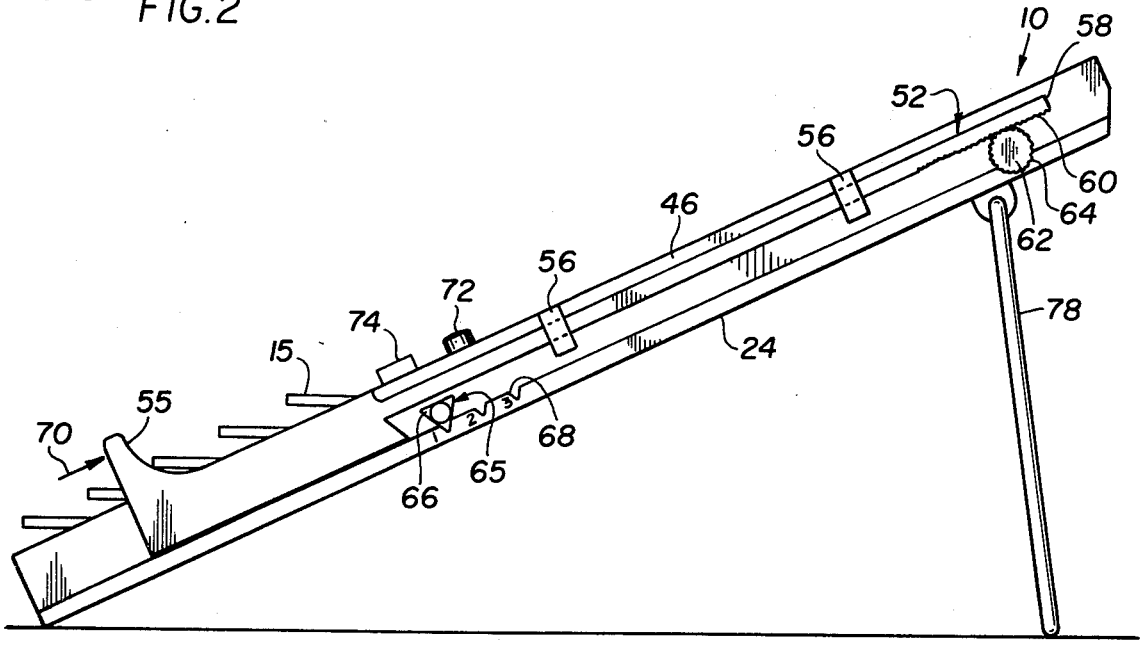
FIG. 3 is a side view of the typewriter in FIG. 1, illustrating one form of the manner in which the paper may be sequentially advanced.

In addition the individual keys 15 are constructed so as to be foldable to lie flat with the housing means 12 so as to produce a very thin typewriter package. The keys can then be opened either by a mechanism, not shown, or in conjunction with the stand 78 that is foldable with respect to the bottom panel 24 of the housing means 12. The stand 78 is easily foldable between an operative or open position, as illustrated in FIGS. 1, 2, and 3, by angular rotation as indicated by double headed arrow 80, to a folded position.

In this manner the typewriter 10 is easily brought into operative position, and the paper 42 may be left therein for prolonged periods of time. The advancing means 52 may also be such as to permit reversal of the movement of the rollers 54 so that the paper 42 may be manually rotated in either direction, since it is necessary to correct errors from time to time.

The paper 42 which is provided initially in the package of paper 11 is such that it has specific characteristics that permit the formation thereon of the typewritten lines such as to obtain the necessary information. The filaments 48 may be such as to produce a red glowing character. The red glowing character corresponds to the letter key 15 being touched, and the character image is then transferred photo-sensitively to the emulsion on the surface of the paper 42.

For example, the emulsion may be sensitive to red light only as an activator for tonal change in the surface. This is why the paper is packaged as illustrated in FIGS. 4–6, to insure that no light will reach it until it is properly exposed. In this manner, the chamber means 16 is kept free of light and is sealed to prevent stray light from entering therein. Therefore, a portion of the paper 42 receiving impressions is exposed only to the red light produced by the filament grids 48.

As the paper is advanced past the printing grids or filaments 48 and out of the machine or typewriter 10, it is automatically exposed to the light source surrounding the typewriter which may be daylight, incandescent, or fluorescent, and each of these sources happen to contain light of the blue and yellow portions of the spectrum. Exposing the emulsions to these portions of the spectrum immediately activates chemicals in the emulsion which inhibit further interaction with light received on the red spectrum from the same source. The impressions received and processed inside the machine or typewriter 10, then, are those which remain fixed in the emulsion outside of the typewriter and are the permanent content of the sheet 42.

Accordingly, the emulsion on each sheet of paper 42 is sensitive to one portion of the light spectrum as an activating agent producing tonal changes in the emulsion, and sensitive to another portion of the light spectrum as a retarder or fixer to stop further tonal change in the emulsion. For example, the red glowing filament 48 produces light in the red spectrum which activates the photo-sensitive emulsion, producing a black character on the surface of sheet 42. The surface of sheet 42 is then exposed to daylight which contains yellow and blue portions of the spectrum as well as red. The red light in the daylight, however, does not further process the emulsion, since the blue or yellow triggers a chemical process in the emulsion which inhibits the red-sensitive chemicals. The tonal changes thus produced may be permanently fixed in the emulsions by this interaction, or simply inhibited in such a manner that the red spectrum activity can be resumed by removing the blue and yellow sources. This latter position is preferable in the case of the typewriter under consideration here since it provides for and facilitates the correction of errors. The correction of errors may be accomplished by selective light sources or chemicals applied to the paper at or near the readout window 76.

The advantage of the emulsion being permanently fixed by blue and yellow interaction with the red sensitive emulsion is in the prevention of accidental damage to the typewritten contents of the sheet should it be unknowingly exposed to a relatively pure red light source. The chances of such an occurance are small or negligible, but the possibility of exposure to "high-red" spectrum lighting suggests that the yellow-blue emulsion should be much more highly sensitized than the red to avert any red "spill-over" under low blue - yellow lighting conditions.

In addition, if the blue-yellow emulsion is activated by the presence of that corresponding light source to inhibit the red, in the absence of all light, then, it seems that the characters so fixed would revert to a pre-sensitized condition; i.e. a blank sheet. However, this would not be the same as an erasure since being re-exposed to red light would re-activate the image prevously printed plus the "corrected" image (assuming the inhibited fixing technique is pressed into the service of facilitating corrections).

Finally, the image printed inside the light - tight housing in the presence of a red-emitting grid should be fixed by a blue or yellow light chamber just prevous to its being rolled out the opening 40. The purpose is to bridge the operational gap between the activization of the emulsion components. Since all three—red yellow and blue components-are activated simultaneously, in normal light, it is possible that there may occur a slight over-all sensitizing of the red emulsion before the fixing agents can interact, producing a graying of the sheet. Another means of avoiding this would be to retard the action of the red sensitized components considerably to give the blue-yellow agents a "head start".

Accordingly, the need to form an erasure on the paper 42 may take place by a chemical which can be applied to cover the mistake which has the emulsion contained therein, such that it can be activated by the grid means 18. In accordance with the present invention the paper 42 can be chemically treated such that there is a division of the light spectrum in that red prints, blue erases or reverses the chemical reaction initiated by red, and yellow inhibits both the printing and erasing processes in the emulsion. Thus, within the typewriter, if the printer is on red, which would be the case when switch 74 is activated, it prints. On the other hand, when switch 75 is activated and it is switched to blue light, it erases what has been printed under that grid unit when being activated.

Yet, under normal light, outside the typewriter, both the red and the blue activated chemicals are inhibited by the yellow portion of the spectrum as it activates the chemicals of the emulsion. Accordingly, the grid means 18 can be activated as discussed above for producing either light of the red spectrum or blue spectrum for either printing or thereafter obtaining an erasure of what has been previously printed with the typewriter 10.

If desired, the paper emulsion can also be designed to remain inactivated, having once been exposed to the printer unit of the grid means 18. When the paper 42 is removed from the typewriter 10, normal light would then initiate the process of developing, but affecting only the portions of the surface having been exposed to the printer grid filaments 48 inside the typewriter 10. Erasure could be effected by an opaque liquid which resensitizes the surface.

As illustrated in FIG. 7, the keyboard 14 has the individual key symbols 15 electrically connected to the electronic controls 20 such that the appropriate key lights the corresponding network of filaments on the filament grid 48 when the respective key 15 is touched. To assure that the light is not received on the paper 42, it is provided in a package 41 that may be completely sealed. As illustrated diagrammatically in FIG. 4, by the arrow 82, the package 41 is first opened, and the top layer of the package and the bottom layer of the package, both designated by numeral 84, are pulled through the rollers 54 in a manner previously discussed as to their rotation. A secondary inner wrapping may be utilized or a simple extra fold in the first sheet of paper which covers the ends of the stack where the package is opened. Once these covering sheets 84 pass through the housing means 12, diagrammatically illustrated in FIGS. 4 through 6, the overlapping sheets of paper 42 are then free to be fed through the advancing means 52. The first sheet of paper in package 41 may be attached inside the wrapper, such that when the wrapper is pulled out of the opening 40, the first sheet or leader strip is pulled out simultaneously into operating position. The sheets of paper may be accordian folded to insure continuous feed through.

The readout window 76 is utilized when the printed line obtained by the grid means 18 is immediately thereafter exposed to a portion of the light spectrum which causes the change to occur to view the printed line. In this manner, prior to the paper exiting from the housing means 12, the typist can look through the transparent window 76 and see if any typographical errors have been made. If a typographical error has been made, then depending upon the type of paper utilized, the corrections may be made as discussed above.

For example, if we are using the system where the blue light resensitizes the paper, then the advancing means 52 would then be utilized to return the paper beneath the grid means 18 and the appropriate key with which the typographical error was made would be contacted to energize the appropriate filament 48. Before this takes place, the typist would engage the erase switch button 75 so as to key the electronic control means 20 by activating means associated therewith, such that the blue light is emitted to reverse the process so as to permit the proper symbol to be typed.

The typewriter 10 may further include paper support means 85 that may take the form of a platform 86 that extends rearwardly of the housing means 12 to support the paper 42 as it exits therefrom. The support means 85 may be foldable or collapsible as is required. The typewriter 10 may further include a stand 88 on one side of the housing means 12 for supporting the paper 90 from which the information is being typed. The stand 88 may be designed to slide within the housing means 12 in the direction of double headed arrow 92. The stand 88 may also be hinged to swing foreward over the face of the housing means 12 to act as a protective covering for the readout window and keyboard.

It is appreciated that more than one battery 34 may be utilized and that the coupling means 20 includes power means for energizing the grid means 18 in response to activation of the keys 15. The electronic circuit of the coupling means 20 is well known in the art and of the type to properly activate the individual filaments 48 to obtain the progressive printing along a line. When the end of a line is reached, the electronic coupling means 20 may immediately shut off such that no further activation of the grid means 18 could take place. In addition, a light or other audible sound device can be utilized when a full complete line of typewritten information has been introduced and typed onto the sheet 42.

Figure 9:
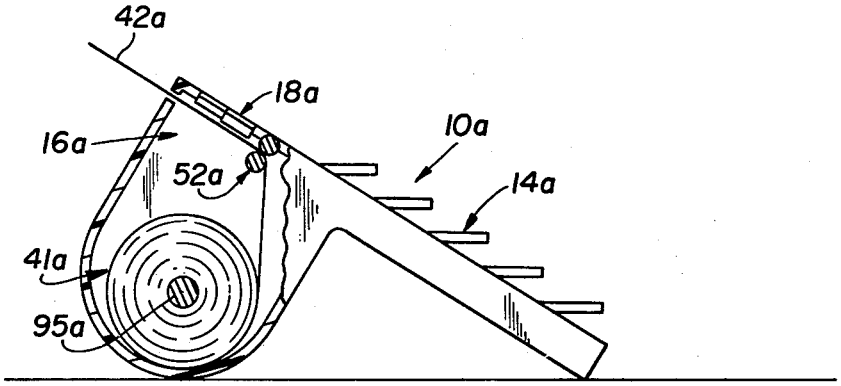
FIG. 9 illustrates a side view, partly in section, of another form of providing the paper within the typewriter.

In accordance with another preferred embodiment of the present invention there is illustrated in FIG. 9 a typewriter 10*a*. The typewriter 10*a* includes the keyboard 14*a* and the advancing means 52*a*, except that the supply of paper 11*a* is in the form of a roll that is mounted for rotation as by shaft 95*a*. The paper 42*a* is then exposed as discussed before with respect to the grid means 18*a* and exit from the chamber means 16*a* in which the roll of paper 42*a* is provided.

Accordingly, there has been disclosed herein a new and novel typewriter that permits the ability to produce on paper in a simple manner typewritten information by photo-electronic means. This is in direct contrast to thermal attempts to obtain printing as disclosed in U.S. Pat. No. 3,453,648. The respective filaments may be in the form of light emitting diodes in order to provide the upper and lower case letters, numerals, punctuation marks, etc. The keyboard can be electrically connected to actuate integrated circuits to illuminate the light emitting diodes. In this manner the paper is exposed by a predetermined intensity and duration. The light is then turned off and the photo-typewriter is ready to print the next character in the line. Circuits are actuated by the same batteries used to provide voltage for the paper advance motor and mechanism, if a power drive is utilized rather than the manual means illustrated herein.

As discussed, the sensitive paper is kept in a container or chamber that is lightproof, and the paper is only exposed when the sentence is completed. The filament grid is made from fine wires which heat to incandescent red when a micro-voltage is applied thereto. In this manner the respective portions of the grid network are energized and produce a glow in the proper pattern for the image to be transferred to the paper.

Although illustrative embodiments of the invention have been described in detail herein with reference to the accompanying drawings, it is to be understood that the invention is not limited to these precise embodiments and that various changes and modifications may be effected therein without departing from the scope or spirit of the invention.

I claim:

1. A typewriter comprising

A. portable housing means,

B. a typewriter keyboard comprising a plurality of individual finger keys on said housing means and being readily engageable by the user thereof, C. chamber means in said housing means for containing a replaceable supply of paper, said paper having an emulsion sensitive to one portion of the light spectrum as an activating agent for producing tonal changes in the emulsion, and sensitive to another portion of the light spectrum as a retarder to stop further tonal change in said emulsion, said chamber being sealed to prevent light from entering therein, D. grid means operatively associated with said housing means and extending in a substantially straight line to produce printed lines, said grid means comprising printing filaments to which said paper is exposed, said filaments being capable of producing light in said portion of the spectrum for producing said tonal changes in the emulsion, such that said paper receiving impressions is exposed only to light produced by said filaments emitting a light glowing image, E. coupling means electrically interconnecting said keys to said grid means so as to progressively activate said grid means across said line in response to each of the keys on said keyboard being engaged during typing, F. said light glowing image of said grid means corresponds to the letter, numeral, or punctuation being touched on said keyboard, and the character image is then transferred photo-sensitively to the emulsion on said paper surface, G. advancing means for moving said paper from said chamber means relative to said grid means, so as to produce line by line exposure of said paper to said grid means, such that the printed grid line is thereafter exposed to the light of said other portion of the light spectrum so as to stop said tonal change in said emulsion, such that printed typewritten lines are produced on said paper, H. means operatively associated with said housing means for inclining same in the operative position thereof so as to facilitate use of said keyboard, and I. means for activating said grid means in another portion of the light spectrum to erase or reverse the chemical reaction initiated by said first portion of the light spectrum to which said paper was first exposed.

2. A typewriter as in claim 1, wherein said filaments produce red light for exposing said paper and the emulsion on the paper is sensitive to red light only as an activator for tonal change in the surface thereof.

3. A typewriter as in claim 1, wherein said filaments take the form of alpha-numeric characters in response to activation of said keys.

4. A typewriter as in claim 1, wherein said advancing means includes rollers engaging opposite sides of said paper for advancing same both forward and backward.

5. A typewriter as in claim 4, and further including means for manually rotating said rollers a selected distance.

6. A typewriter as in claim 1, wherein said chamber means includes means for mounting a roll of said paper therein.

7. A typewriter as in claim 1, wherein said chamber is adapted to receive said paper in a package having overlapping sheets to be fed through the typewriter.

8. A typewriter as in claim 1, and further including paper support means extending rearwardly of said housing means to support said paper as it exits from said housing means.

9. A typewriter as in claim 1, and further including a readout window extending across said housing means.

10. A typewriter as in claim 1, and further comprising a stand to one side of said housing means for supporting the paper being typed from.

11. A typewriter as in claim 1, wherein said coupling means includes power means for energizing said grid means in response to activation of said keys.

12. A typewriter as in claim 11, wherein said coupling means includes batteries.

13. A typewriter comprising

A. portable housing means including a readout window extending across said housing means, and chamber means for receiving a supply of paper therein, said chamber being sealed to prevent light from entering therein, B. a typewriter keyboard comprising a plurality of individual finger keys on said housing means and being readily engageable by the user thereof, C. a supply of paper having an emulsion sensitive to one portion of the light spectrum as an activating agent for producing tonal changes in the emulsion, and sensitive to another portion of the light spectrum as a retarder to stop further tonal change in said emulsion, D. grid means operatively associated with said housing means and extending in a substantially straight line to produce printed lines, said grid means comprising printing filaments to which said paper is exposed, said filaments being capable of producing light in said portion of the spectrum for producing said tonal changes in the emulsion, said light glowing image of said grid means corresponding to the letter, numeral, or punctuation being touched on said keyboard, and the character image is then transferred photo-sensitively to the emulsion on said paper surface, E. coupling means electrically interconnecting said keys to said grid means so as to progressively activate said grid means across said line in response to each of said keys on said keyboard being engaged during typing, said coupling means including power means for energizing said grid means in response to activation of said keys, F. activating means for energizing said grid means in another portion of the light spectrum to erase or reverse the chemical reaction initiated by said first portion of the light spectrum to which said paper was first exposed, G. advancing means for moving said paper from said chamber means relative to said grid means, and said readout window so as to produce line by line exposure of said paper to said grid means, such that the printed grid line is thereafter exposed to the light of said other portion of the light spectrum so as to stop said tonal change in said emulsion, wherein printed typewritten lines are produced on said paper, said advancing means including rollers engaging opposite sides of said paper for advancing same, H. paper support means operatively associated with said housing means to support said paper as it advances past said grid means, I. said portion of said paper receiving impressions is exposed only to light produced by said filaments, J. said filaments produce a first light for exposing said paper and the emulsion on the paper is sensitive to said first light only as an activator for tonal change in the surface thereof, K. said activating means produce a second light different from said first light in said filaments to erase or reverse the chemical reaction, and L. means operatively associated with said housing means for maintaining said housing inclined when in the operative position thereof.

14. A typewriter as in claim 13, and further including means for manually rotating said rollers a selected distance.

15. A typewriter as in claim 13, wherein said chamber means includes means for mounting a roll of said paper therein.

16. A typewriter as in claim 13, wherein said chamber is adapted to receive said paper in a package having overlapping sheets to be fed through the typewriter.

* * * * *